US006447242B1

(12) United States Patent
Wilhelm

(10) Patent No.: US 6,447,242 B1
(45) Date of Patent: Sep. 10, 2002

(54) FEED PUMP

(75) Inventor: Hans-Dieter Wilhelm, Anspach (DE)

(73) Assignee: Mannesmann VDO AG (DE)

( * ) Notice: Subject to any disclaimer, the term of this patent is extended or adjusted under 35 U.S.C. 154(b) by 0 days.

(21) Appl. No.: 09/673,336

(22) PCT Filed: Feb. 3, 2000

(86) PCT No.: PCT/EP00/00849

§ 371 (c)(1),
(2), (4) Date: Jan. 17, 2001

(87) PCT Pub. No.: WO00/47899

PCT Pub. Date: Aug. 17, 2000

(30) Foreign Application Priority Data

Feb. 13, 1999 (DE) ..... 199 06 130

(51) Int. Cl.[7] ..... F04D 1/12
(52) U.S. Cl. ..... 415/55.1; 415/55.2
(58) Field of Search ..... 415/55.1, 55.2, 415/55.3, 55.4, 55.5, 55.6, 55.7; 416/228, 237

(56) References Cited

U.S. PATENT DOCUMENTS

| | | | | |
|---|---|---|---|---|
| 1,619,285 A | | 3/1927 | Burks | |
| 2,842,062 A | | 7/1958 | Wright | 103/96 |
| 2,923,246 A | | 2/1960 | Wright | 103/96 |
| 3,359,908 A | * | 12/1967 | Toma | 415/55.5 |
| 3,592,566 A | * | 7/1971 | Beardslee | 417/423 |
| 3,768,920 A | * | 10/1973 | Gerwin | 415/148 |
| 3,782,850 A | | 1/1974 | Egli et al. | 415/53 T |
| 4,306,833 A | | 12/1981 | Sixsmith et al. | 415/53 T |
| 5,265,996 A | | 11/1993 | Westhoff et al. | 415/52.1 |
| 5,527,150 A | | 6/1996 | Windhofer | 415/55 |
| 5,642,981 A | * | 7/1997 | Kato et al. | 415/55.1 |

FOREIGN PATENT DOCUMENTS

| | | | |
|---|---|---|---|
| DE | 3925396 A1 | 7/1991 | F04D/5/00 |
| EP | 89110124.8 | 5/1989 | F04D/5/00 |

* cited by examiner

*Primary Examiner*—Edward K. Look
*Assistant Examiner*—Ninh Nguyen
(74) *Attorney, Agent, or Firm*—Mayer, Brown, Rowe & Maw

(57) ABSTRACT

In a feed pump designed as a side-passage pump and having a driven impeller rotating in a housing a liquid to be fed is supplied radially from the inside to guide blades arranged in the impeller. For this purpose, the impeller has a groove adjoining the guide blades. As a result, Feed pump has an especially high efficiency.

20 Claims, 3 Drawing Sheets

FEED PUMP

BACKGROUND OF THE INVENTION

1. Field of the Invention

The present invention relates generally to the field of fluid pumping mechanisms. More specifically, the present invention is useful in an embodiment as a fuel pump wherein an impeller rotates in a housing for pumping fluid.

2. Description of the Related Art

Such feed pumps are known as peripheral or side-passage pumps and are used, for example, in modern motor vehicles for feeding fuel or washing liquid. During rotation of the impeller, the guide blades in the feed chamber produce a circulation flow running transversely to the direction of movement of the guide blades. The circulation flow enters the blade chambers in the radially inner region of the impeller and discharges from the blade chambers in the radially outer region. To adapt the feed pump to an intended characteristic and to the viscosity of the liquid to be fed, the angle of inclination of the guide blades and the chamber volumes can be calculated and adapted. This adaptation is decisive for the efficiency of the feed pump in the intended application.

A disadvantage with the known feed pump is that vorticity is induced in the circulation flow upon entry to the blade chambers. These vortices lead to a disturbance in the circulation flow and thus to a low efficiency of the feed pump. Furthermore, the circulation flow has an especially low pressure in the entry region of the blade chambers, so that, for example, liquids which are close to their boiling point may vaporize due to the vortices and may thus reduce the efficiency of the feed pump to an especially pronounced degree. In particular, the feed pump used as a fuel pump in a motor vehicle therefore often has a very low efficiency.

SUMMARY OF THE INVENTION

The problem underlying the invention is to design a feed pump of the type mentioned at the beginning in such a way that vortices are kept especially small and that the feed pump has as high an efficiency as possible.

This problem is solved according to the invention in that the feed chamber is designed for directing the liquid from a radially inner region of the impeller into the blade chambers.

Due to this design, deflection of the circulation flow upon entry to the blade chambers is avoided. Since the flow is accelerated to an especially high degree in the radial direction inside the blade chambers in accordance with the design of the guide blades, vortices are markedly reduced by the radial entry of the circulation flow into the blade chamber. As a result, the liquid to be fed does not tend to vaporize. For this reason, the feed pump according to the invention has an undisturbed circulation flow and thus an especially high efficiency.

The feed pump according to the invention turns out to be of especially simple design if the guide blades project into the graduated-ring-shaped passage. In the feed pump designed as a peripheral pump, the circulation flow can hereby be directed precisely from inside to outside through the blade chamber.

In another advantageous development of the invention, the impeller is designed as a flat component which can be produced in an especially cost-effective manner if the impeller has a groove in its region adjoining the guide blades radially on the inside. As a result, the incident flow to the guide blades takes place at least partly via the groove.

In order to avoid overflow of liquid to the inlet passage, the circulation flow must be interrupted downstream of the outlet passage as viewed in the direction of rotation of the impeller. Overflow of liquid from the outlet passage to the inlet passage via the groove in the impeller can be avoided in a simple manner if the housing has a projecting web penetrating into the groove of the impeller.

The web could be arranged, for example, solely between the outlet passage and the inlet passage and designed to fill the groove. However, in another advantageous development of the invention, the web has high stability if the web is of ring-shaped design and has a widened portion outside the region of the graduated-ring-shaped passage, the widened portion filling the groove. Furthermore, the groove may thereby have an appropriate width for cost-effective production of the impeller. In addition, the impeller has an especially low weight and thus a low inertia due to this design.

In another advantageous development of the invention, vortices inside the feed chamber can be reduced further if a guide element for directing the flow in the feed chamber is arranged in the groove and/or on the web.

In another advantageous development of the invention, uniform acceleration of the circulation flow in the blade chambers can be achieved in a simple manner if the guide blades, in their radially inner region, have an entry bevel pointing in the direction of rotation of the impeller. This helps to keep vortices of the circulation flow especially small.

The feed pump according to the invention, which feed pump is intended as a fuel pump, has an especially high efficiency if an angle of inclination of the entry bevel is approximately 55° to 70°, preferably 60°, relative to the remaining region of the guide blade.

The circulation flow enters the blade chambers with an especially low velocity if the guide blades have a smaller wall thickness in their radially inner region than in their radially outer region. Furthermore, this helps to further reduce the vortices when the circulation flow strikes the guide blades.

In another advantageous development of the invention, guidance of the circulation flow in the intended manner can be reliably ensured if a housing part carrying the web and a housing part mounting the impeller have centering grooves and centering webs engaging one inside the other.

BRIEF DESCRIPTION OF THE DRAWINGS

The invention permits numerous embodiments. To further illustrate its basic principle, several of them are shown in the drawing and are described below. In the drawing.

DETAILED DESCRIPTION OF THE PREFERRED EMBODIMENTS

Figure 1:
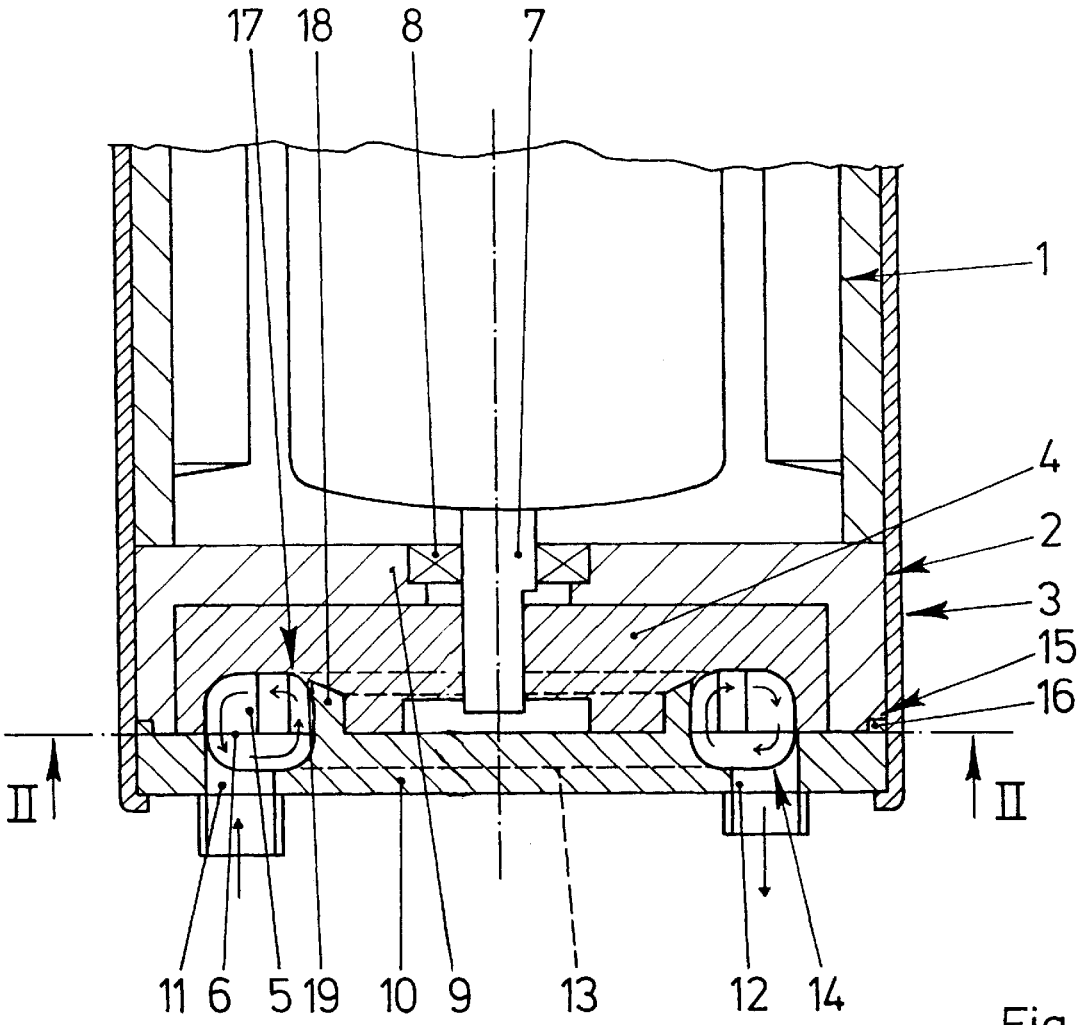
FIG. 1 shows a schematic longitudinal section through a feed pump according to the invention with an electric motor.

FIG. 1 shows a longitudinal section of a feed pump 2 according to the invention driven by an electric motor 1. The feed pump 2 has an impeller 4 arranged so as to be rotatable in a housing 3 and having a ring of guide blades 6 defining blade chambers 5. The impeller 4 is fastened to a shaft 7 of the electric motor 1. The shaft 7 is guided in a bearing 8 of a housing part 9 of the housing 3, the housing part 9 being arranged between the electric motor 1 and the feed pump 2. In the region facing the guide blades 6, the housing 3 has a further housing part 10 in which a graduated-ring-shaped passage 13 extending from an inlet passage 11 to an outlet passage 12 is made. The blade chambers 5 and the graduated-ring-shaped passage 13 form a feed chamber 14 for the liquid to be fed. The housing part 9 mounting the shaft 7 has a centering groove 15, and the housing part 10 having the graduated-ring-shaped passage 13 has a centering web 16 penetrating into the centering groove 15.

During rotation of the impeller 4, a circulation flow develops in the feed chamber 14 and is directed radially outward inside the blade chambers 5 from the radially inner region facing the shaft 7. While the liquid passes the blade chambers 5 of the impeller 4, the circulation flow experiences an increase in its kinetic energy. For clarification, the flows of the liquid are identified by arrows.

The impeller 4 has a groove 17 in its region adjoining the guide blades 6 radially to the inside. In its region facing the guide blades 6, the groove 17 is half filled by a web 18 of the housing part 10 having the graduated-ring-shaped passage 13. At its deepest point, the groove 17 has a guide element 19 for directing the flow into the blade chambers 5. Between the web 18 and the guide blades 6, the circulation flow can thus enter the groove 17 free of vortices. The liquid then passes out of the groove 17 to the guide blades 6. In this way, the liquid is supplied to the blade chambers 5 from the radially inner region of the impeller 4, so that the flow is not deflected when striking the guide blades 6. Therefore especially small vortices are produced in the feed chamber 14, so that the feed pump 2 according to the invention has an especially high efficiency.

Figure 2:
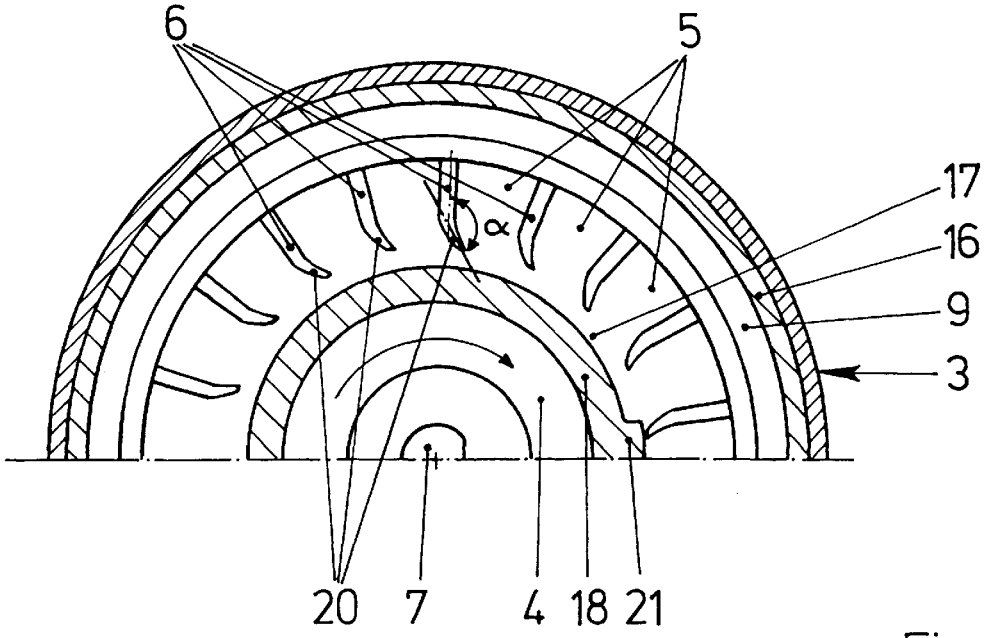
FIG. 2 shows the feed pump from FIG. 1 in a sectional representation along line II—II.

FIG. 2 shows the end face of the impeller 4 in a sectional representation through the feed pump 2 from FIG. 1 along line II—II. Here, it can be seen that the guide blades 6, in their radially inner region, have an entry bevel 20 pointing in the direction of rotation of the impeller. An angle of inclination of the entry bevel 20 is approximately 600° relative to the remaining region of the guide blade 6. The entry bevels 20 are designed to taper at their free end, so that the flow of the liquid; is uniformly accelerated when entering the blade chambers 5. As viewed in the direction of rotation of the impeller 4, the web 18 has a widened portion 21 between the outlet passage 12 shown in FIG. 1 and the inlet passage 11. With the widened portion 21, the web 18 fills the entire groove 17 in the impeller 4. In this way, overflow of liquid from the outlet passage 12 shown in FIG. 1 to the inlet passage 11 is largely avoided.

Figure 3:
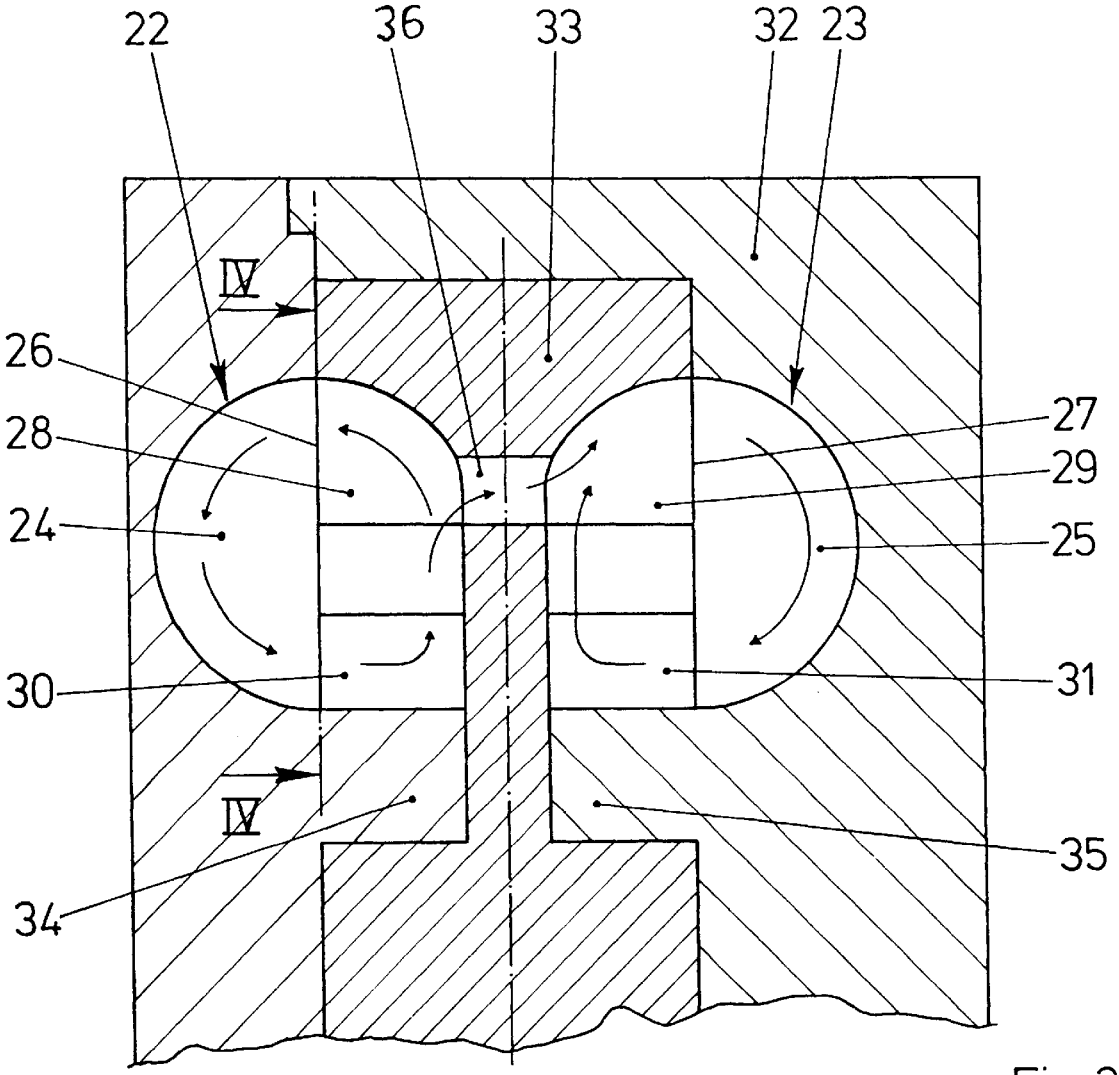
FIG. 3 shows a sectional representation through a further embodiment of the feed pump according to the invention in the region of the feed chambers.

FIG. 3 shows a radially outer region of a further embodiment of the feed pump according to the invention. The feed pump has an impeller 33 rotatable in a housing 32 and two feed chambers 22, 23 opposite one another. The feed chambers 22, 23 are in each case composed of a graduated-ring-shaped passage 24, 25, blade chambers 28, 29 defined by guide blades 26, 27, and a groove 30, 31 adjoining the blade chambers 28, 29. Penetrating into the grooves 30, 31 in each case are webs 34, 35 which are made in one piece with the housing 32 and occupy approximately half the width of the grooves 30, 31. Blade chambers 28, 29 opposite one another are connected to one another, so that the liquid can flow over from one side of the impeller 33 to the other side during a pressure gradient between the feed chambers 22, 23. For clarification, the flows of the liquid in the feed chambers 22, 23 and possible overflow from one of the feed chambers 22 into the other feed chamber 23 are identified by arrows.

Figure 4:
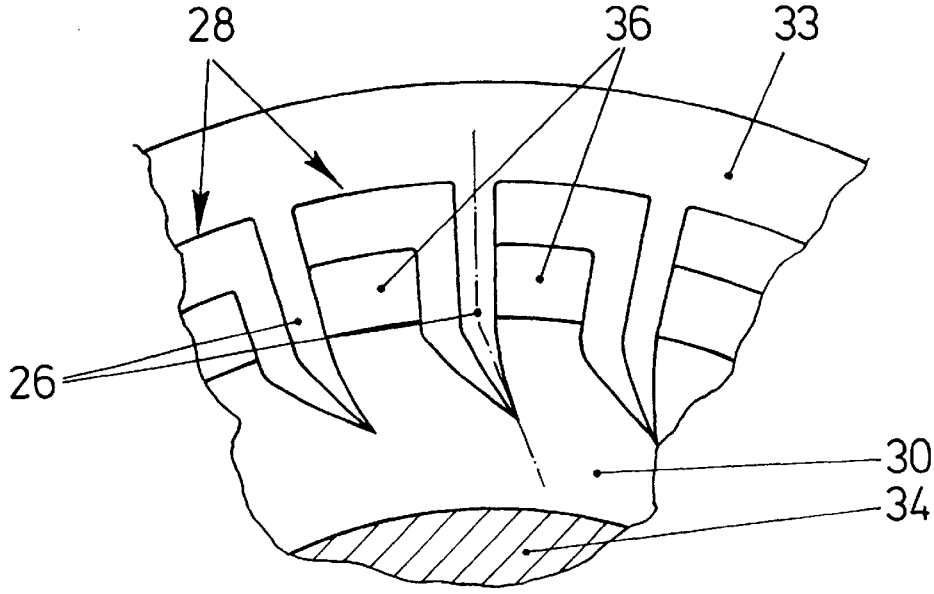
FIG. 4 shows a sectional representation through the feed pump from FIG. 3 along line IV—IV.

FIG. 4, in a sectional representation through the feed pump from FIG. 3, shows that the impeller 33 has windows 36 for connecting the blade chambers 28, 29 opposite one another. In the direction of rotation of the impeller 33, the guide blades 26, 27 are in each case designed to rise from an axially inner region of the impeller 33 toward its end faces.

Figure 5:
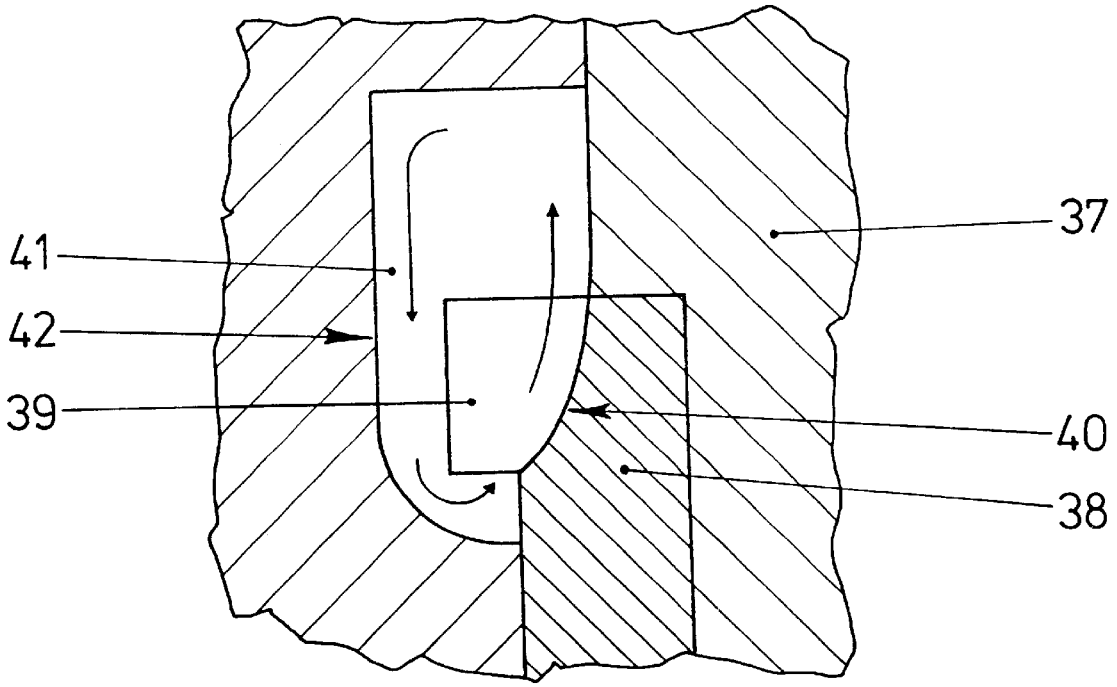
FIG. 5 shows a sectional representation through a further embodiment of the feed pump according to the invention in the region of a feed chamber.

FIG. 5 shows a radially outer region of a further embodiment of the feed pump according to the invention. In contrast to the feed pumps from FIGS. 1 and 3 designed as side-passage pumps, this feed pump is designed as a peripheral pump. In this case, an impeller 38 which is rotatable in a housing 37 has guide blades 39 arranged at its periphery for defining blade chambers 40. The guide blades 39 project centrally into a graduated-ring-shaped passage 41 of the housing 37, so that the liquid is directed from a radially inner region of the graduated-ring-shaped passage 41 to a radially outer region. The graduated-ring-shaped passage 41 and the blade chambers 40 form a feed chamber 42. In this case, the flow through the blade chambers 40 takes place virtually without deflection.

What is claimed is:

1. A pump comprising:

an impeller secured in a housing, said impeller including a ring of guide blades defining blade chambers and a groove in a region adjacent the guide blades;

a graduated-ring-shaped passage arranged in the housing in the region of the guide blades, said graduated-ring-shaped passage forming a feed chamber with the blade chambers for feeding a liquid from an inlet passage to an outlet passage, and further wherein the feed chamber is designed for directing liquid from a radially inner region into the blade chambers;

wherein the housing has a projecting web penetrating into the groove of the impeller; and wherein the web is a ring shaped web with a widened portion outside the region of the graduated-ring-shaped passage and wherein the widened portion fills the groove.

2. The feed pump according to claim 1, wherein the guide blades extend into the graduated ring-shaped passage.

3. The feed pump according to claim 1, further comprising a guide element for directing flow in the feed chamber arranged in the groove.

4. The feed pump according to claim 1, wherein a portion of the housing carrying the web and the portion of the housing mounting the impeller have centering grooves and centering webs respectively engaging the impeller and web.

5. A pump comprising:

an impeller secured in a housing, said impeller including a ring of guide blades defining blade chambers;

a graduated-ring-shaped passage arranged in the housing in the region of the guide blades, said graduated-ring-shaped passage forming a feed chamber with the blade chambers for feeding a liquid from an inlet passage to an outlet passage, and further wherein the feed chamber is designed for directing liquid from a radially inner region into the blade chambers;

wherein the guide blades have an entry bevel in a radially inner region pointing in the direction of rotation of the impeller; and wherein an angle of inclination of the entry bevel is approximately 55–70° relative to a remaining region of the guide blade.

6. The feed pump according to claim 5, wherein the guide blades extend into the graduated ring-shaped passage.

7. The feed pump according to claim 5, wherein the impeller has a groove in a region adjacent the guide blades.

8. The feed pump according to claim 7, wherein the housing has a projecting web penetrating into the groove of the impeller.

9. The feed pump according to claim 8, wherein the web is a ring shaped web with a widened portion outside the region of the graduated-ring-shaped passage and wherein the widened portion fills the groove.

10. The feed pump according to claim 5, further comprising a guide element for directing flow in the feed chamber arranged in the groove.

11. The feed pump according to claim 5, wherein the guide blades have a smaller wall thickness in a radially inner region than in a radially outer region.

12. The feed pump according to claim 5, wherein a portion of the housing carrying the web and the portion of the housing mounting the impeller have centering grooves and centering webs respectively engaging the impeller and web.

13. A pump comprising:

an impeller secured in a housing, said impeller including a ring of guide blades defining blade chambers;

a graduated-ring-shaped passage arranged in the housing in the region of the guide blades, said graduated-ring-shaped passage forming a feed chamber with the blade chambers for feeding a liquid from an inlet passage to an outlet passage, and further wherein the feed chamber is designed for directing liquid from a radially inner region into the blade chambers;

wherein the guide blades have a smaller wall thickness in a radially inner region than in a radially outer region.

14. The feed pump according to claim 13, wherein the guide blades extend into the graduated ring-shaped passage.

15. The feed pump according to claim 13, wherein the impeller has a groove in a region adjacent the guide blades.

16. The feed pump according to claim 15, wherein the housing has a projecting web penetrating into the groove of the impeller.

17. The feed pump according to claim 16, wherein the web is a ring shaped web with a widened portion outside the region of the graduated-ring-shaped passage and wherein the widened portion fills the groove.

18. The feed pump according to claim 13, further comprising a guide element for directing flow in the feed chamber arranged in the groove.

19. The feed pump according to claim 13, wherein the guide blades have an entry bevel in a radially inner region pointing in the direction of rotation of the impeller.

20. The feed pump according to claim 13, wherein a portion of the housing carrying the web and the portion of the housing mounting the impeller have centering grooves and centering webs respectively engaging the impeller and web.

* * * * *